US012618164B2

(12) United States Patent
Nehlsen et al.

(10) Patent No.: US 12,618,164 B2
(45) Date of Patent: May 5, 2026

(54) ELECTRODE ATTACHMENT ASSEMBLY, CELL AND METHOD OF USE

(71) Applicant: VERSUM MATERIALS US, LLC, Tempe, AZ (US)

(72) Inventors: James Patrick Nehlsen, Emmaus, PA (US); William F. Schulze, Tempe, AZ (US)

(73) Assignee: Versum Materials US, LLC, Tempe, AZ (US)

( * ) Notice: Subject to any disclaimer, the term of this patent is extended or adjusted under 35 U.S.C. 154(b) by 561 days.

(21) Appl. No.: 18/043,906

(22) PCT Filed: Nov. 4, 2020

(86) PCT No.: PCT/US2020/058775

§ 371 (c)(1),
(2) Date: Mar. 2, 2023

(87) PCT Pub. No.: WO2022/055528

PCT Pub. Date: Mar. 17, 2022

(65) Prior Publication Data

US 2023/0332305 A1 Oct. 19, 2023

Related U.S. Application Data

(60) Provisional application No. 63/075,561, filed on Sep. 8, 2020.

(51) Int. Cl.

| | |
|---|---|
| ***C25B 9/63*** | (2021.01) |
| ***C25B 1/245*** | (2021.01) |
| ***C25B 11/043*** | (2021.01) |

(52) U.S. Cl.

CPC ..... *C25B 9/63* (2021.01); *C25B 1/245* (2013.01); *C25B 11/043* (2021.01)

(58) Field of Classification Search

None

See application file for complete search history.

(56) References Cited

U.S. PATENT DOCUMENTS

| | | |
|---|---|---|
| 3,041,266 A | 6/1962 | Cable et al. |
| 3,655,535 A | 4/1972 | Ruehlen et al. |

(Continued)

FOREIGN PATENT DOCUMENTS

| | | |
|---|---|---|
| CN | 1137808 A | 12/1996 |
| CN | 1921298 A | 2/2007 |

(Continued)

OTHER PUBLICATIONS

Copper Development Association Inc ("C11000", 2015, referred to as CAD) (Year: 2015).*

(Continued)

*Primary Examiner* — Alexander W Keeling

(74) *Attorney, Agent, or Firm* — Daniel A. Demarah, Jr.; Versum Materials US, LLC

(57) ABSTRACT

Electrode attachment assemblies for electrolytic cells and electrolytic cells having one or more electrode attachment assemblies and the method of using the same are provided that comprise a carbon-containing electrode and one or more deformable attachment elements in direct or indirect contact with said carbon-containing electrode, wherein said one or more deformable attachment elements will deform at a stress lower than the stress that results in fracture of the carbon-containing electrode to accommodate the expansion of the carbon-containing electrode when in use.

31 Claims, 6 Drawing Sheets

(56) References Cited

U.S. PATENT DOCUMENTS

| | | | | |
|---|---|---|---|---|
| 3,676,324 | A | 7/1972 | Mills | |
| 3,708,416 | A | 1/1973 | Ruehlen et al. | |
| 3,720,597 | A | 3/1973 | Ashe et al. | |
| 3,915,836 | A * | 10/1975 | Born | C25B 9/63 204/268 |
| 4,647,356 | A | 3/1987 | Leroy | |
| 5,160,415 | A | 11/1992 | Kondo | |
| 5,290,413 | A | 3/1994 | Bauer et al. | |
| 5,688,348 | A | 11/1997 | Diaz et al. | |
| 5,688,384 | A | 11/1997 | Hodgson et al. | |
| 6,063,255 | A | 5/2000 | Bauer et al. | |
| 6,210,549 | B1 | 4/2001 | Tharp | |
| 8,349,164 | B2 | 1/2013 | Furuta et al. | |
| 9,528,191 | B2 | 12/2016 | Krouse et al. | |
| 2008/0314759 | A1 | 12/2008 | Furuta et al. | |
| 2013/0233723 | A1 | 9/2013 | Morelle et al. | |
| 2014/0110269 | A1 | 4/2014 | Nehlsen | |
| 2015/0114831 | A1 * | 4/2015 | Kawasaki | C25B 9/23 204/252 |
| 2015/0240367 | A1 | 8/2015 | Krouse et al. | |

FOREIGN PATENT DOCUMENTS

| | | | | |
|---|---|---|---|---|
| CN | 101783428 | A | 7/2010 | |
| CN | 102337491 | A | 2/2012 | |
| CN | 204434734 | U | 7/2015 | |
| CN | 108463190 | A | 8/2018 | |
| CN | 109487296 | A * | 3/2019 | C25B 9/65 |
| CN | 110546798 | A | 12/2019 | |
| CN | 110661009 | A | 1/2020 | |
| EP | 0442644 | A1 * | 8/1991 | C25B 1/245 |
| EP | 0852267 | A2 | 7/1998 | |
| EP | 3647467 | A1 | 5/2020 | |
| GB | 2135335 | A | 8/1984 | |
| JP | 2000355786 | A | 12/2000 | |
| JP | 6599411 | B2 | 10/2019 | |
| JP | 7173664 | A | 11/2022 | |
| KR | 10-2000-0004094 | A | 1/2000 | |
| KR | 100286717 | B1 | 6/2001 | |
| KR | 10-2006-0010538 | A | 2/2006 | |
| WO | 2022/055528 | A1 | 3/2022 | |

OTHER PUBLICATIONS

ASTM "Standard Classification for Temper Designations for Copper and Copper Alloys—Wrought and Cast"). (Year: 2018).*

"Extended European Search Report received for European Patent Application No. 20953495.7, mailing date Sep. 20, 2024", 8 Pages.

"International Preliminary Report on Patentability received for PCT Application No. PCT/US2020/058775, mailing date Mar. 23, 2023", 7 Pages.

"International Search Report and Written Opinion received for PCT Application No. PCT/US2020/058775, mailing date Jun. 2, 2021", 10 Pages.

* cited by examiner

ELECTRODE ATTACHMENT ASSEMBLY, CELL AND METHOD OF USE

CROSS-REFERENCE TO RELATED APPLICATIONS

This application is a National Stage filing under 35 U.S.C. 371 of International Patent Application No. PCT/US2020/058775, which claims priority to U.S. provisional application 63/057,561 filed on Sep. 8, 2020, the entire contents of both are incorporated herein by reference thereto for all allowable purposes.

BACKGROUND OF THE INVENTION

The industrial generation of elemental fluorine ($F_2$) and related fluorinated gases such as nitrogen trifluoride ($NF_3$) occurs primarily in electrolytic cells. For fluorine gas generation especially, the anodes of such cells are made from carbon. To function, the anodes must be connected to a source of electrical power such that electrical current can flow between the cathodes and anodes.

Making a reliable connection to the anodes in a fluorine cell is challenging due to the very aggressive chemical conditions found in such cells. The liquid electrolyte used in such cells is typically a molten salt mixture of potassium fluoride (KF) and hydrogen fluoride (HF). To generate $NF_3$, ammonium fluoride is used in place of or in addition to KF. This electrolyte, combined with the elevated operating temperature and the anodic potential applied to the anodes, creates highly corrosive conditions that tend to attack the metallic components of the anode connection apparatus. Furthermore, for efficient and stable operation, the electrical resistance of the connection to the anodes must start and remain low throughout the lifetime of the anode. Any deterioration in the electrical connection to the anode is known to cause breakage of the anode, as thoroughly described by Ring and Royston (Australian Atomic Energy Commission Report E281, 1973, ISBN 0 642 99601 6).

Many ways to attach a carbon anode to the electrical source and/or other support member have been suggested in the prior art including those disclosed in U.S. Pat. No. 5,290,413 (circumferential metal sleeve around the anode top), U.S. Pat. No. 3,041,266A (metal hanger bar with the anodes attached via several bolts), JP7173664A (threaded bolts inserted first through a metal bar and then into the carbon anode), U.S. Pat. No. 5,688,384 (screws in the top of the carbon anode), KR100286717 B1 (carbon anode is held between two metal plates by bolts), CN102337491 A (clamping plates), U.S. Pat. No. 8,349,164 (clamping plates), Zhao, et al. (clamping plate), U.S. Pat. No. 6,210,549 (C-shaped anode hanger bar and a threaded rod).

Despite the many different attachment methods, the carbon anodes fracture during use in electrolysis after a period of time. The fracture of the carbon anode renders the cell unusable and requires that at least some portion of the cell be rebuilt. There is therefore a need in the art to extend the life of the carbon electrodes in an electrolytic cell.

BRIEF SUMMARY OF THE INVENTION

This invention provides an electrode attachment assembly and an electrolytic cell comprising an electrode attachment assembly, said electrode attachment assembly comprising a carbon-containing electrode and one or more deformable attachment elements in direct or indirect contact with said carbon-containing electrode, wherein said one or more deformable attachment elements will deform at a stress below the fracture strength of the carbon-containing electrode to accommodate the expansion of the carbon-containing electrode when in use.

In another embodiment, this invention provides an electrolytic cell comprising one or more electrode attachment assemblies of the present invention, a container, an electrical distribution member, an electrolytic bath and one or more oppositely charged electrodes.

In yet another embodiment, this invention provides a method or use of the electrolytic cell to manufacture fluorine-containing materials comprising the step of introducing electrical energy into said electrolytic cell to cause chemical reactions at said carbon-containing electrode and said one or more oppositely charged electrodes to produce fluorine-containing materials at said carbon-containing electrode.

This invention provides the benefit of a cell and electrode attachment assemblies, which may be anode attachment assemblies that reduce the tendency of carbon electrodes (anodes) to fracture, thereby extending the life of the electrodes, which enables longer cell operation, lowers maintenance costs by reducing the frequency of rebuilding cells and improves safety. Broken electrodes (anodes) can sometimes cause electrical shorting inside the cell or lead to electrical arcing, resulting in damage to many of the cell's internal components. This invention further provides electrode attachment assemblies (anode attachment assemblies) possessing good electrical contact and resistance to corrosion. Corrosion of the electrical connection to the carbon electrode may also be reduced by keeping the connection points and metallic components "dry", that is, preferably above the surface of the liquid electrolyte. Cells made using the electrode attachment assemblies of this invention are useful, in some cases, for 20% longer or more, as compared to conventional electrodes operated in comparable cells, under the same operating conditions.

DETAILED DESCRIPTION OF THE INVENTION

All of the patents and patent applications referred to anywhere in the Background or this Description are hereby incorporated herein by reference in their entireties.

Figure 1:
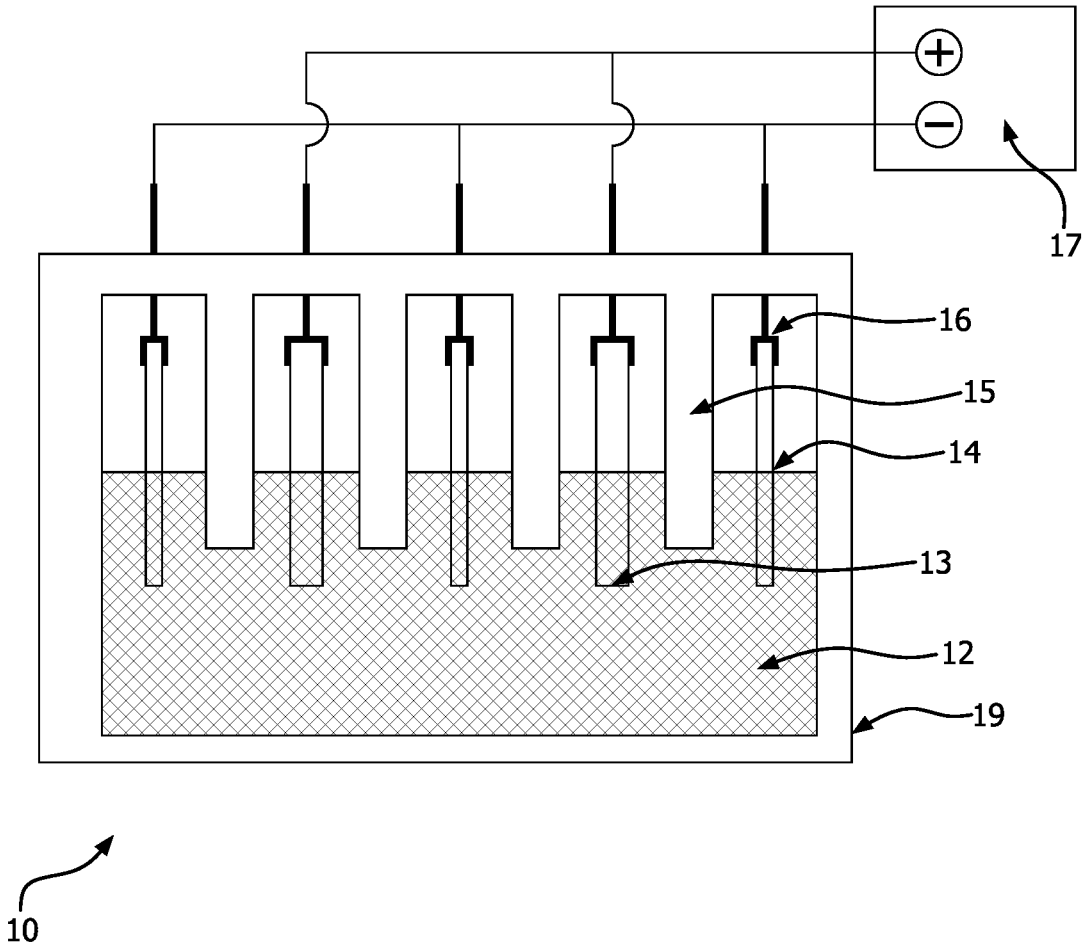
FIG. 1 is a schematic of an electrolytic cell of this invention.

FIG. 1 is a simple schematic view showing one embodiment of an electrolytic cell for electrolytic synthesis of a fluorine-containing material having an electrode attachment assembly therein according to the invention. Reference numeral 10 designates an electrolytic cell for electrolytic synthesis of a fluorine-containing material using a fluoride ion-containing molten salt electrolytic bath 12 in electrolyte-resistant container 19. The fluoride ion-containing molten salt electrolytic bath 12 may comprise a mixed molten salt containing one or more fluoride salts and hydrogen fluoride (HF), such as KF-2HF, $NH_4$-2HF, or a mixture of KF, $NH_4F$ and HF and the like. The electrolytic cell further comprises anodes 13, cathodes 14 and partition walls 15 which are at least partially immersed in the molten salt electrolytic bath 12. The electrolytic cell further comprises a electrical current distribution member, which may be a feeder bus bar 16, optional rectifier and electrical power source 17. The cathode 14, typically comprises nickel, stainless steel, carbon steel, or the like. The anode 13 typically comprises a carbon-containing material. The electrode assembly of this invention comprises at least one electrode, typically at least one anode, and an attachment assembly comprising one or more deformable elements, which may also be referred to as a deformable attachment assembly, embodiments of which will be shown in more detail in FIGS. 2-6. The electrolytic cell 10, of this invention, may additionally comprise means to maintain the temperature (not shown) and means to replenish the salt (not shown), such as the HF and/or $NH_3$, consumed during the process of generating the fluorine-containing material, which may be, fluorine gas, nitrogen trifluoride, or other fluorinated gas. It is understood that this invention can be used for any carbon-containing electrode, (although it may be described herein as an anode) to make any final product, although typically a fluorine-containing material.

In the embodiment shown in FIG. 1, when the electrolytic cell 10 is operated, the electrical energy causes chemical reactions in the cell bath. The fluorine-containing material is made at the anode 13. The partition wall 15 keeps the fluorine-containing gas separated from the hydrogen gas made at the cathode 14. The hydrogen gas and the fluorine-containing gas are released from the cell via separate conduits (not shown) connected to separate collection containers (not shown).

The anode 13 used in the electrochemical fluorine generating cell is typically made of a carbon-containing material, such as, carbon or ungraphitized carbon, though carbons with varying degrees of graphitization, including fully graphitized carbon, may be used. (Note, the carbon-containing material may be used to make a cathode in other electrolytic cells which would benefit from this invention; therefore this invention is not limited to anodes made of carbon-containing material and therefore the terms carbon-containing electrode, carbon-containing anode and carbon electrode and carbon anode may be used interchangeably herein.) The carbon-containing material used to make the electrode can be low-permeability, or high-permeability, monolithic structure, or a composite structure. In a composite structure, there may be an inner core of low-permeability carbon and an outer shell of high-permeability carbon or a conductive diamond layer. Alternately in a composite structure, the carbon-containing anode may comprise a carbon fiber material and another form of carbon, such as an isostatically pressed carbon powder or mesocarbon microbeads. The outer layers of the carbon electrode may be formed, coated or attached to the inner core or alternative support (see UK Patent Application 2 135 335 A (Marshall)) or otherwise assembled or fabricated (see U.S. Pat. No. 3,655,535 (Ruehlen et al.), U.S. Pat. No. 3,676,324 (Mills), U.S. Pat. No. 3,708,416 (Ruehlen et al.), and U.S. Pat. No. 3,720,597 (Ashe et al.), and US 2008/0314759 (Furuta et al). Also useful in the invention are carbons that have been impregnated with metals such as nickel or with salts such as lithium fluoride. Also useful in the invention may be carbon electrodes that are coated with a thin layer of metal in the area that the anode meets or is connected to the electrical power supply to that anode. The surface of the carbon may be rough or may be cut or polished smooth. The surface may also contain features such as grooves or holes. Any carbon anode comprising any useful type of carbon may be used as the carbon electrode in the electrode assembly of this invention. Commonly, the carbon-containing electrodes used as anodes in electrolytic cells are generally a shaped mass of compressed carbon comprising a form of coal or petroleum-derived coke and a pitch binder. The formed anodes are typically baked to densify, harden, and to carbonize the pitch. Isostatically pressed blocks of carbon powder can also be used, which can be formed directly into the final shape or machined from larger blocks into a final shape. The carbon anodes are generally rectangular in shape having approximately planar or flat surfaces, but they can have any shape, such as, the shape of a square, disk or cylinder, etc.

Through much investigation of the causes of anode breakage, the inventors discovered an unrecognized mode of failure. They discovered that electrodes comprising carbon-containing materials of the type used in electrolytic cells for fluorine and fluorinated gas production undergo physical swelling during use. The extent of this swelling is generally small, less than 1% for most carbons under the conditions found inside the electrolytic cells. However, this amount of swelling is sufficient to generate enough stress to fracture the carbon in most attachment designs. The amount of physical expansion can vary but is typically from about 0.1% to about 2.0% increase in each dimension of the carbon electrode.

To demonstrate this feature, three samples of ungraphitized carbon ("ABR" grade manufactured by SGL Carbon, Wiesbaden, Germany) were placed in a vessel and exposed to conditions similar to the gas phase headspace of a fluorine cell containing HF and $F_2$ gases at 100° C. After several charges of gas, the samples were removed and found to have increased in size by 0.27%, 1.42%, and 0.53% in each length dimension.

Because the swelling of the carbon is induced by the conditions found inside the electrolytic cell during operation, the inventors determined that this phenomenon causes excessive stress and breakage. The swelling of the anode comprising carbon-containing material is large in comparison with the classic mechanical elastic compression and elongation experienced by all of the materials in pressurized contact with the carbon electrode, that is, all of the attachment elements in direct or indirect contact with and supporting the electrode in the cell and/or providing the electrical power to the electrode. It was also discovered that, in contrast to the changes induced by other means such as thermal expansion, the swelling of the carbon anodes is not reversible. Once the carbon undergoes the swelling, it retains the new, larger size even when the cell is shut off. Furthermore, the inventors discovered that the swelling process is not self-limiting. Rather, the carbon will continue to expand slowly over time. This effect prevents the user from pre-expanding the carbon before mounting in an electrolytic cell, since the carbon will continue to expand once mounted and placed into service in an electrolytic cell.

The devices generating the pressurized contact (clamping force) that hold the carbon anodes in place and provides the contact pressure necessary for good electrical connection are typically very strong. Attachment elements, such as bolts, bands, and threaded rods have all been used as structural members to provide the pressurized contact. Multiple materials of construction are useful, including steel, copper, nickel, and nickel-copper alloys such as Ni—Cu alloy 400.

The choice of material in the prior art was often based on corrosion resistance and the ability to withstand the mechanical stress of the assembly conditions. The inventors discovered that the use of these types of high-strength materials causes anode failure after a period of operating time, because these materials are much stronger than the carbon anode and will not yield when the carbon swells. The carbon materials typically used to make the electrodes in such cells have brittle failure behavior, that is, they tolerate a small amount of elastic deformation before failing via brittle fracture. The carbon materials of the carbon anode do not exhibit any, or only very limited, ductile deformation behavior that also decreases as the electrode ages with use.

When attached to a rigid, high-strength attachment element, such as a steel, nickel, or conventional cold-rolled copper bolt, rod, band, plate, hanger, or clamping device or combinations thereof, at the conventional compression forces applied to insure adequate physical and electrical connections between the carbon anode and one or more of those attachment elements, the carbon can only expand slightly before reaching its limit of elastic deformation. The result is fracturing of the carbon at or near the point of maximum stress induced by the attachment element The use of pressure-distributing devices such as a clamping plate does not prevent this mode of failure because the underlying cause is the expansion of the carbon within the confines of a rigid attachment element or elements.

The inventors determined that deflections in the metal bolts and plates in conventional attachment elements at normal assembly conditions may be on the order of 10 microns, while the expansion of the carbon that is the subject of this invention may be 100 microns or more. Stated differently, the expansion of the carbon-containing material of the anode due to swelling when used in the electrolytical cell to make a fluorine-containing material is greater than the expansion of the conventional attachment element and may be greater than 1.5×, or greater than 2×, or greater than 5×, or greater than 8× the expansion of the conventional attachment element. Therefore, the difference in the scale of expansion between the carbon and the conventional attachment element leads to the inability of conventional (rigid) attachment elements to accommodate the carbon expansion.

Exacerbating the problem of anode fracture is the fact that carbon-containing materials typically weaken over time with use. The weakening can be a result of chemical degradation or attack by the harsh oxidizing environments typically found in these cells or internal stresses caused by the swelling. As a result, after a period of use, the carbon-containing materials often exhibits a lower compressive strength than when new. This reduction can be as much as 50%. Avoiding fracture of the carbon-containing materials therefore relies on the ability to reduce the peak stress on the carbon-containing materials to relatively low values.

Most carbon-containing materials used as anodes in electrolytic cells for the generation of fluorine and other fluorinated gases have a compressive strength around 8,000 to 15,000 pounds per square inch (psi) when new. After extended use in an electrolytic cell, this value can decrease by up to half due to chemical degradation of the carbon and the effects of the swelling. Thus, stresses above about 6,000 psi are likely to break the carbon after a period of use.

This invention provides a deformable attachment element, cell and method that prevents anode fracture by accommodating the swelling of the anode comprising carbon-containing material and thereby extend the useful lifetime of the electrolytic cell. To accomplish that, the deformable attachment elements of this invention reduce the peak stress on the carbon-containing material to relatively low values.

Conventional components used to attach the anode via an attachment or clamping force, such as a bolt, band, or rod, were designed to operate within the elastic limits of the material. Higher stresses dictated the use of higher strength materials or attachment devices with larger cross-sections to reduce the stress in the attachment element. Conventionally, the prior art attachment devices used one or more attachment devices to generate high attachment or clamping pressures with a focus on protecting the contact surfaces from corrosion and achieving low electrical resistance in the joint via high contact stresses.

In contrast, this invention provides that the attachment of carbon anodes in an electrolytic cell can be improved by the use of one or more compliant or yielding attachment elements to accommodate the physical swelling of the carbon. Such one or more deformable attachment elements can expand, preferably between from about 0.1% to about 2% or from about 0.1% to about 1% in length (and/or other dimensions), through either elastic or plastic deformation while limiting the maximum stress applied to the carbon to be less than the fracture strength of the carbon. Since the carbon may weaken over time, the design should limit peak stress on the carbon to less than 8,000 psi, or less than 7,000 psi and more preferably to less than 6,000 psi or even to less than 5,500 psi. The one or more deformable elements used in the electrode attachment assembly must be selected to provide adequate displacement, which is typically at least between from about 0.05 to about 10%, or from about 0.05 to about 5%, or from about 0.1 to about 3% or from about 0.1 to about 2% of the original carbon dimensions.

This can be achieved through the use of ductile, low-yielding metals or reduced cross-sections in the attachment elements that transmit the attaching force, that may be a clamping force, such as the bolt shaft, rod, or bands. The material and cross-sections must be selected together to ensure that the component reaches its yield point and is able to deform in a ductile manner prior to exerting higher stress, than the carbon fracture stress, on the carbon electrode.

One embodiment of a ductile, low-yielding metal is fully annealed copper, also known as an O60 temper. The copper is any industrially pure grade such as alloy C11000. Copper metal is well known to work harden. In the conventional state for machined copper parts, copper is provided in the so-called "cold-rolled" state, alternately called "⅛ hard" or H00 temper, and has a minimum yield strength at 0.5% extension of 20,000 psi (137.9 MPa). Harder versions, such as ¼ hard or ½ hard are also available. Fully annealed copper, in contrast, has no specified minimum yield strength at 0.5% extension but the value is typically very low, less than about 10,000 psi (69 MPa) and often about 6,500 psi (44.8 MPa). Machined copper parts must typically be annealed to achieve the O60 temper. Besides copper and its alloys, other metals that can be suitable include lead, gold, silver, tin, zinc, aluminum, brass, bronze, and various alloys of these metals.

As stated above, the thickness of a metal element may be increased to increase its rigidness; therefore, to make a deformable attachment element useful in this invention using stronger known metals, including steel, Monel or the like, it is possible to reduce the thicknesses of the metal element to allow for the creation of a deformable attachment element. Because the harsh conditions in the electrolytic cell often lead to corrosion over time, it may only be possible to reduce the thickness of some elements using stronger metals used in the prior art if more than one deformable element is used in the attachment assembly.

Figure 2:
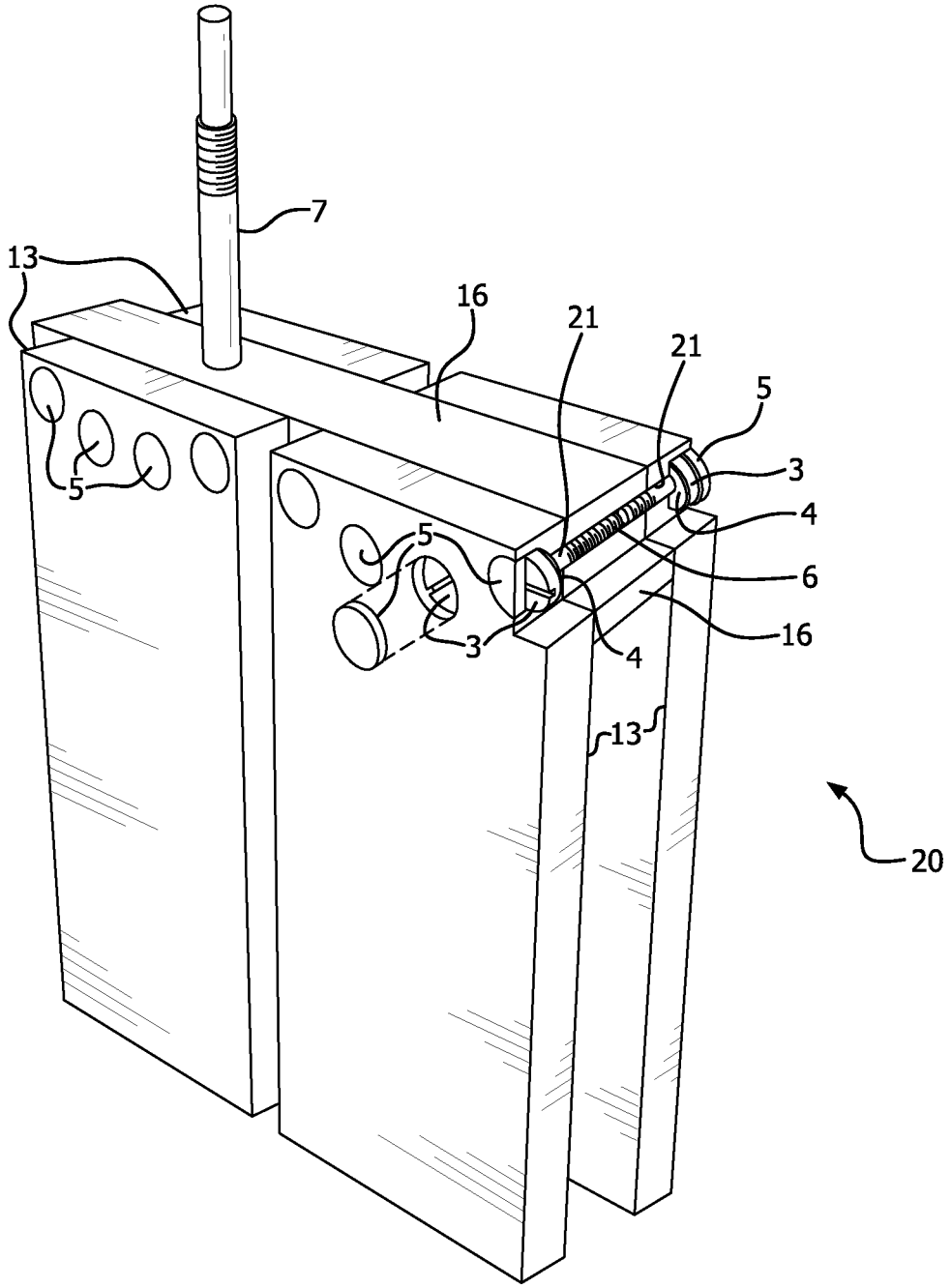
FIG. 2 is a schematic of one electrode attachment assembly of this invention.

For example in the embodiment shown in FIG. 2, from U.S. Pat. No. 3,041,266, ¾-inch diameter 4100-series steel alloy metal bolts that were used conventionally for anode attachment were replaced with bolts made of H00 copper and reduced to less than about 0.5 inches in diameter to allow the plastic deformation of the bolts to occur before the carbon anode fractured. Carbon steel bolts could also be used, but the diameter must be further reduced to less than 0.3 inches in diameter. The reductions in the bolt shaft diameter should be made preferably without altering the original bolt cap seating area too much, that is, the bolt shaft must be thinner but the cap should remain close to, if not, the same size. The combination of size and material properties must be considered such that the deformable attachment element will yield sufficiently at a point before the carbon fractures, considering all relevant stress concentrations created by the details of the mechanical attachment design. Therefore, changes to the bolt shaft diameter must also occur without changing the landing area for the bolt head on the carbon in this example, lest the stresses on the carbon be increased. Therefore, the need to consider these many different criteria, plus factors such as ampacity for electrical current-carrying members, requires great care to achieve all necessary requirements.

In alternative embodiments, heat annealed copper may be used to make the deformable attachment element or the deformable zone or deformable portion thereof. Heat annealed copper, such as ASTM O60 temper, does not have a specification yield stress, but has been found to deform under a stress of about 10,000 psi (69 MPa) or less. For comparison, H00 temper copper has a yield stress of 20,000 psi (138 MPa) and most common steels have a yield stress of 25,000 psi (172 MPa) or higher.

As described above, some common metals for this service such as cold-rolled H00 copper, steel, or copper-nickel alloy 400 can be used as deformable components, but only with careful design to ensure the material yields prior to fracturing the carbon. Other metals or materials that can be used include lead, gold, silver, tin, zinc, aluminum, brass and bronze. Conductive polymers, such as graphite-filled polytetrafluoroethylene (PTFE) could also be used for current-carrying members. Soft materials such as plastics and elastomers can be used for non-current carrying components, though they must still have sufficient strength to bear the mechanical loads required and be chemically compatible with the environment in the cell. Preferably the deformable attachment elements comprise metal. Preferably the deformable attachment elements are free or substantially free of elastomeric elements and materials that react, combust, degrade, or are otherwise incompatible with the cell environment. Preferably the deformable attachment elements are conductive and provide a conductivity greater than 300 S/m. In some designs, the deformable attachment elements are load-bearing.

In CN204434734U, a flexible member between the carbon anode plate and the metallic buss bar is disclosed. Such flexible members are designed to seal the joint between these elements to prevent corrosion. The flexible member is claimed to be a graphite gasket with a metallic coating. Such flexible members do not fulfill the function required of the present invention because they typically do not have enough compressibility remaining after the initial compression set during assembly.

Elastomeric components can be used as the deformable element or as one of several deformable elements in an electrode assembly if properly designed. The elastomeric component must be chemically compatible with the cell environment or protected from it. Halogenated elastomers such as FKM (fluoroelastomer), FFKM (fluoroelastomer), chloroprene, and other similar materials can be used. A halogenated or unhalogenated polymer such as silicone rubber or any of the various hydrocarbon-based elastomers could be used if protected by encapsulation with a resistant material, such as a fluoropolymer. The elastomeric component must allow for sufficient deformation of the carbon after initial assembly without generating the stress needed to fracture the carbon. Therefore, the elastomeric component cannot be completely compressed during the initial assembly of the electrode assembly.

Useful deformable attachment elements useful in the electrode attachment assemblies of this invention may include one or more of them in any combination: springs, conical or spring washers, coil springs or other spring bolts, screws, posts, rods, shafts, threaded rods, bands, straps, bracings, crush washers, conical or spring washers, U- or C-shaped hanger bars, C-shaped clamps, and elastomeric pads, gaskets or washers. The deformable attachment elements alone or in any combination are designed with the appropriate mechanical properties, or deformable portions thereof, to provide for their deformation. The deformable attachment elements may comprise deformable portions or zones, that is, portions of the elements that comprise deformable materials or are otherwise designed to deform under pressure to prevent fracturing the electrodes.

As discussed above, FIG. 2 shows one embodiment of this invention. FIG. 2 shows an anode attachment assembly 20 of this invention comprising one or more deformable attachments elements. As shown, the deformable attachment elements are a plurality of bolts designed to yield plastically at a stress sufficiently low to prevent fracture of the carbon. The bolt could be constructed of a soft metal such as annealed copper or can be a hard metal such as steel or nickel-copper alloy 400, but with reduced cross-sectional area of the bolt. FIG. 2 shows a common copper metal hanger or bus bar 16 is supported by a metallic rod 7 which is affixed to bus bar 16 by any suitable means. Rod 7 may extends through an opening in the top of the electrolytic cell (not shown) and may be employed in combination with a tap nut (not shown) for securing the rod 7 to the top of the cell. Rod 7 may also be used for connecting to a source of electrical power.

As shown in FIG. 2, a plurality of carbon anodes 13 are affixed to the bus bar 16. Each of the anodes 13 has a plurality of holes, drilled completely therethrough. Each of these holes is counter-bored to provide a shoulder or land for the head of a bolt 3. Each of the bolts 3 has a slot-head and a shaft 21 as shown. A copper washer 4 is inserted under the head of each of the bolts 3 for protection of the carbon anode. Each of the bolts 3 is provided with screw-threads which engage the internal threads of a hole 6 in the bus bar 16 for thus securing the anodes 13 to the bus bar 16, as shown in the cut away portion of the drawing.

In this embodiment, the head of each of bolts 3 is protected from corrosion by a carbon or elastomer plug 5. These plugs 5 may be slightly tapered to insure a tight fit in the recessed holes but are also designed in accordance with this invention to allow for expansion of the carbon-containing electrode.

Figure 3:
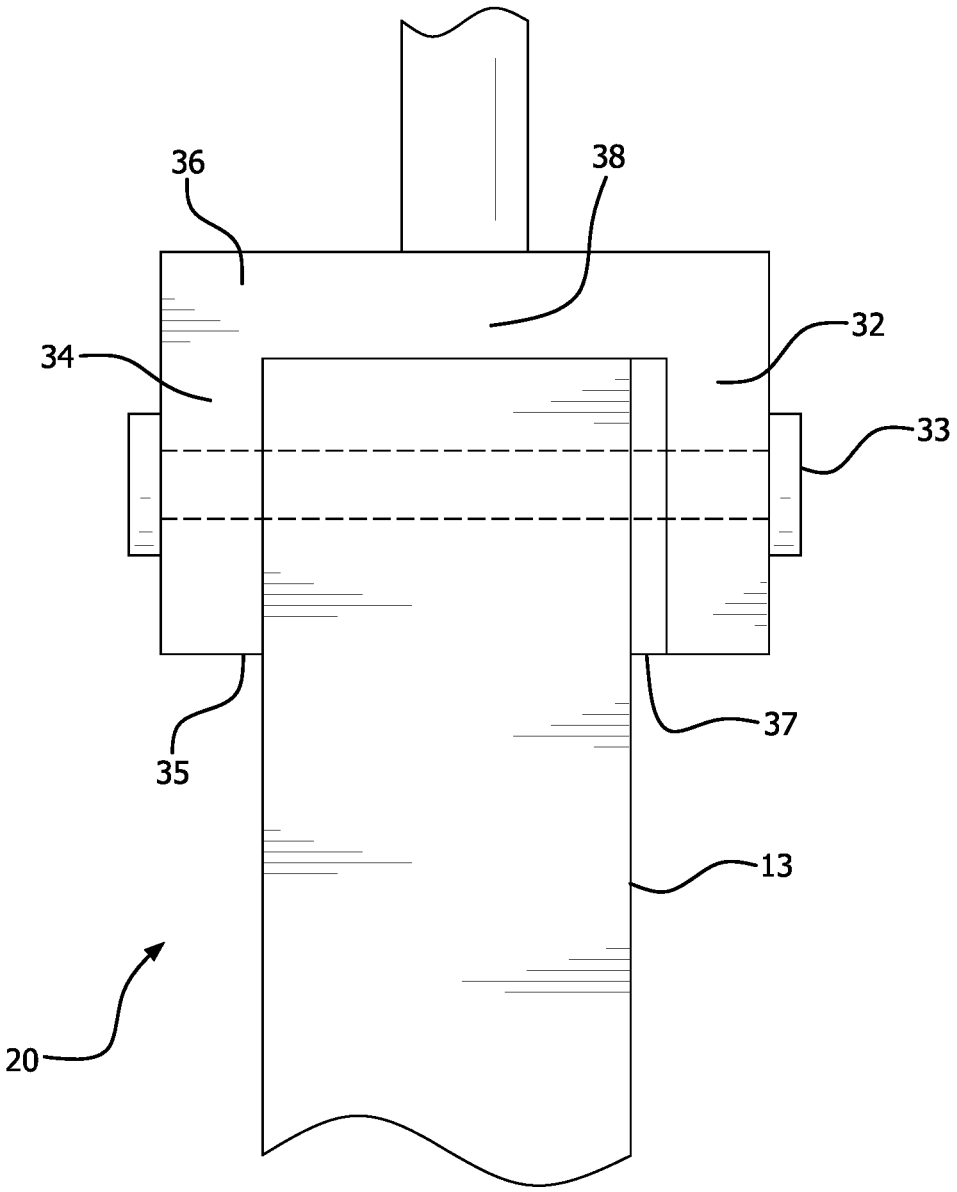
FIG. 3 is a schematic of another electrode attachment assembly of this invention.

FIG. 3 shows another embodiment of the electrode assembly 20 comprising one or more deformable attachment elements. The electrode assembly 20 comprises a U- or C-shaped hanger 36 with a bolt 33, for example, a load-bearing bolt like as shown in FIG. 3. In conventional mechanical designs, bolts are selected such that the bolt shaft does not yield under the applied stress. In this invention, the attachment of a carbon anode 13 in an electrolytic cell can be improved by using bolts 33 (and/or other elements) that deform by yielding, allowing the carbon to expand without reaching sufficient stress to crack the carbon. The clamping force on the carbon is created by compressing a U- or C-shaped hanger 36 with a bolt 33. If the bolt is rigid, as the carbon swells during use, the clamping force increases until the stress on the carbon is sufficiently high to fracture the carbon which typically occurs at the lower edge 35 of the U- or C-shaped hanger, where the geometry of the edge generates a shear stress concentration point in the carbon-containing electrode in contact with the edge 35. To prevent this, a deformable bolt 33 and/or an elastomeric element 37 and/or a deformable C or U shaped hanger may be used or any combination of those deformable elements may be used. If an elastomeric element 37 is used, it may be inserted between at least one surface of the U-shaped or C-shaped hanger and the carbon anode. FIG. 3 shows the U- or C-shaped hanger 36 comprising side portions 32, 34 and top portion 38 that is located between and connects side portions 32 and 34. FIG. 3 shows the elastomeric element 37 between one side portion 32 of the anode U- or C-shaped hanger and the anode 13. Alternatively, the elastomeric element 37 can be located between either or both side portions 32, 34*s* and the anode 13, and/or between one side portion 32, or 34 and the top portion 38 of the hanger and the anode 13, or between both side portions 32, 34 and the top portion 38 of the hanger 36 and the anode 13 as long as provisions are made for the electrical current to pass through the hanger or other electrical current provider (not shown) into the electrode. As the carbon expands, the elastomeric element is compressed, and/or the bolt may expand in length and/or the hanger may deflect, thereby, preventing the stresses on the carbon from increasing to the fracture point of the carbon.

Figure 4:
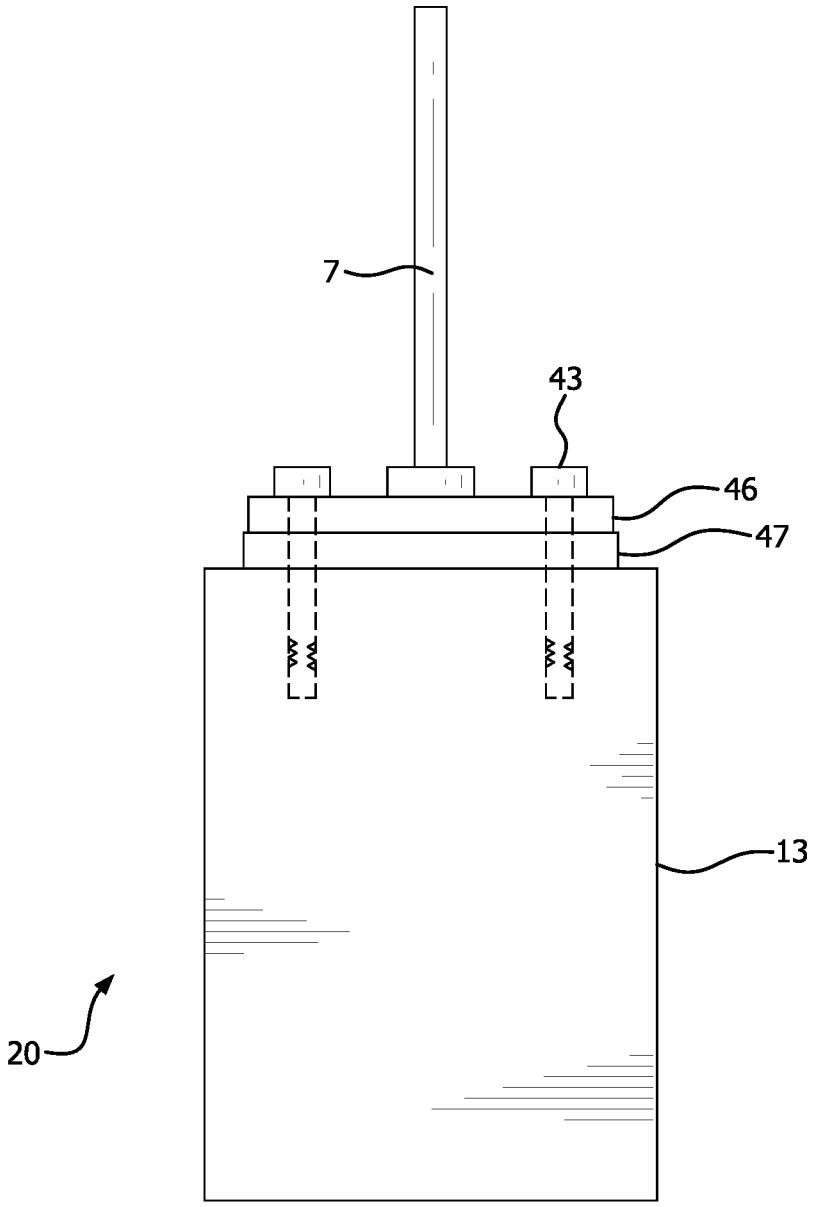
FIG. 4 is a schematic of another electrode attachment assembly of this invention.

FIG. 4 shows another embodiment of a deformable electrode assembly 20 of this invention comprising an elastomeric component and/or deformable bolts or posts. Threaded bolts or posts are attached through the anode support 46 and into the anode 13 as shown in FIG. 4. FIG. 4 also comprises an elastomer element 47 located between the anode 13 and metal support 46. By positioning the elastomer element 47 between the anode 13 and metal support 46, the elastomer element 47 will deform when the carbon anode swells. Without the elastomer element 47 present, the swelling carbon anode would cause the clamping forces between the anode and the bus bar or support 46 support to increase, causing breakage of the carbon anode 13 at the point of highest stress, typically where the bolt threads engage the carbon anode. With the elastomeric component present, as the carbon swells during use, the elastomeric component is compressed, preventing the clamping force from increasing sufficiently to fracture the carbon of the anode 13. Additionally, or alternatively, the bolts and posts may be made of a soft metal, such as annealed copper, or another soft metal as described above, that yields plastically as the carbon swells and does not generate enough stress to fracture the carbon.

In alternative embodiments, posts or rods can be used to provide mechanical support and electrical contact internal to the carbon anode. Regardless of the number or position of the posts or rods, the expansion of the carbon in the direction co-axial with the post will exert significant stress on the carbon in the zone where the engagement between the carbon and the post occurs, such as where the post is threaded. When the carbon swells in use, the stress generated at these points will fracture the carbon. Deformable posts and rods, therefore, should be used whether they are used for mechanical support or electrical contact if the swelling of the electrode comprising a carbon-containing material contacts the post or rod.

Figure 5:
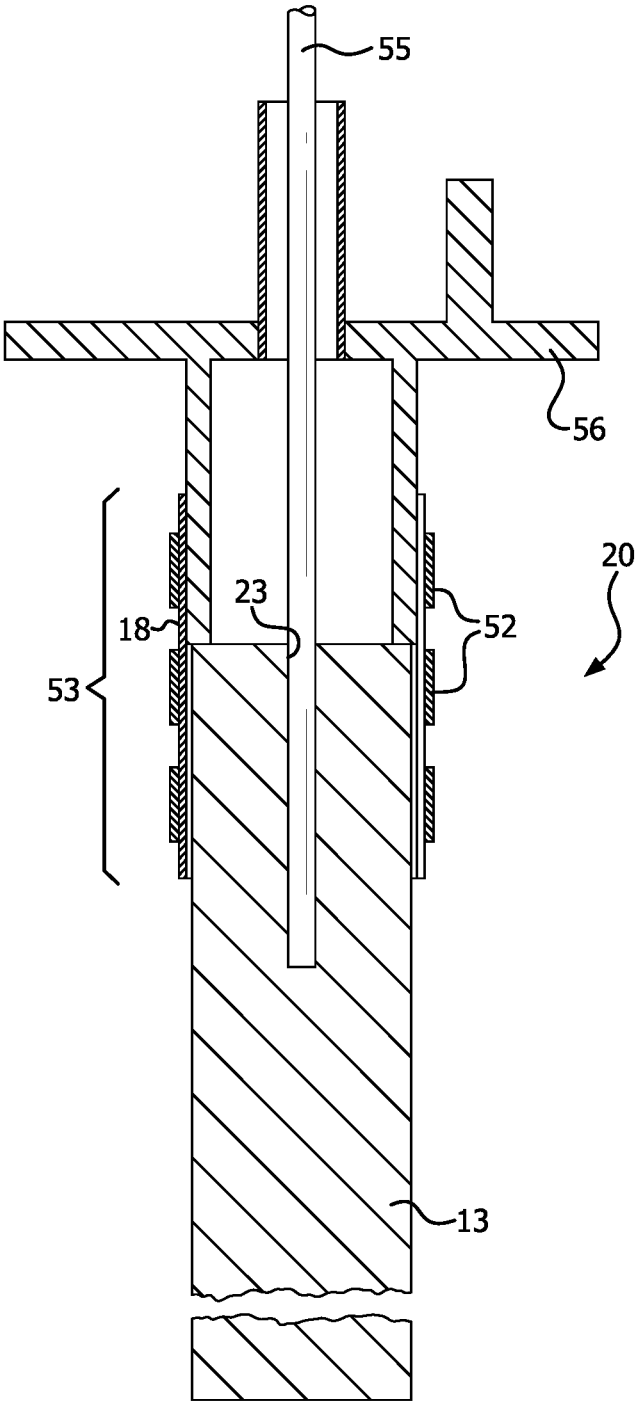
FIG. 5 is a schematic of another electrode attachment assembly of this invention.

FIG. 5 shows another embodiment of the electrode attachment assembly 20 of this invention comprising one or more deformable elements. In FIG. 5, the electrode assembly 20 comprises a carbon-containing anode 13 surmounted by metal support 56. Anode 13 and metal support 56 are encircled by an anode current carrier 53 comprising a metal sleeve 18 and a compression means 52. Anode 13, metal support 56 and metal sleeve 18 are circumferentially compressed together by compression means 52. Optional anode probe 55 is shown descending through an opening in the center of metal support 56 into anode 13 which may be a sheathed thermocouple that measures the temperature and voltage in anode 13. Typically, a small hole 23 is drilled into the geometric center of anode 13. In this embodiment, care is taken in the thermocouple design to provide for the expansion of the carbon around the hole. The compression means 52 used to provide the compressive force between the current carrier 53 and the carbon anode 13 may be one or more bands, straps, or other bracings. The metal sleeve 18 may also provide some compression around the carbon anode. The current carrier 53 provides the compressive force to hold the anode and generate electrical communication between the sleeve and the carbon anode. The bands or straps are deformable, that is, they are made using low-yielding metals or with stronger metals having the appropriate cross-section to allow them to plastically deform as the carbon anode swells during use.

Figure 6:
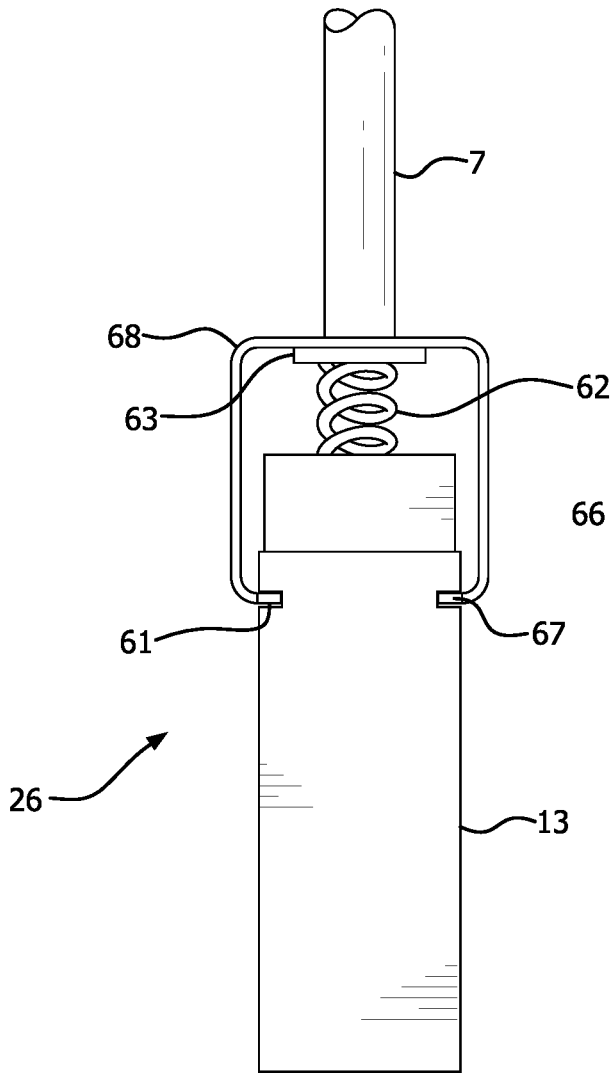
FIG. 6 is a schematic of another electrode attachment assembly of this invention.

FIG. 6 shows another embodiment of the electrode attachment assembly of this invention comprising deformable attachment elements. In this embodiment, at least one of the deformable attachment element(s) comprise(s) elements having spring-like action. Examples of elements having spring-like action include conical or spring washers, coil springs or other spring types known in the art. Additionally, one or more C-shaped clamp 68 with an opening smaller than the size of the carbon anode can also be used as springs, utilizing the natural spring constant of the metal used to make the C-shaped clamp 68 or deformable portion of the C-shaped clamp. If one or more springs 62 are used, the spring constants, as the deformable attachment element, alone or in combination with other attachment elements, must be selected to achieve a force that does not generate enough stress on the carbon to cause fracture when the carbon expands, typically by from about 0.1% to about 2% or more in its dimensions.

FIG. 6 shows an electrode attachment assembly 20 having a spring 62 as at least one of the deformable attachment elements. The electrode attachment assembly also comprises a C-shaped clamping member 68 that supports the anode 13. Both the C-shaped clamping member 68 and the coil spring 62 serves as deformable elements, and are designed to deform elastically to permit the expansion of the carbon without generating sufficient stress to break the carbon. In use, the carbon swells generating forces horizontally on the C-shaped clamp and vertically on the metal element 66. The C-shaped clamp 68 is deformable and expands elastically outward from the anode to accommodate the expansion, while the spring 62 is compressed (deforms) to permit the vertical expansion of the carbon. The attachment assembly is shown having a rod 7 and a spring connector 63. The elements 7, 68, 63, 62 and 66 may all be welded together or connected via bolts and nuts (not shown), and the electrode 13 may be held in place against the metal support 66 by the metal channel piece 67 that is part of the C-shaped clamping member 68. The metal channel piece 67 fits into a channel 61 machined or otherwise formed in the electrode 13 to receive it.

In some embodiments, the element of the anode attachment assembly that generates the mechanical clamping force used to hold the anode in place is deformable. For example, if a bolt is inserted into a hole in the anode such that the hole has a wider diameter than the bolt even after the expansion of the carbon, then the bolt must still be designed to accommodate the expansion of the carbon anode by having a deformable shaft or cap.

When the deformable element is a bolt, it is preferred that the bolt is designed to allow the bolt shaft or shank to expand. However, other portions of the bolt may also be designed to deform instead of or in addition to the shaft or shank. For some embodiments, the deformable attachment element will be equally deformable across the entire length and/or width and/or diameter of the attachment element. In other embodiments, the deformable attachment element may comprise a "deformation zone" or just a portion of the element that is deformable. For examples, the deformation zone of the bolt may be its shank or just a portion of the shank, where for example, the diameter of the shank may be narrower and/or may comprise a different material, a different metal for example.

As it will be seen below by using this invention the life of the electrodes can be extended more than 30%, or more than 50%.

EXAMPLES

This invention is illustrated by example as follows. The cell attachment method described in detail in U.S. Pat. No. 3,041,266 utilizes four high-strength, alloy 4100-series steel bolts to attach each carbon anode. The carbon has a fracture strength of about 12,000 psi (82.7 MPa) when new, slowly dropping to about 6000 psi (41.4 MPa) during service as a result of chemical degradation. The bolts have a 0.75 inch (1.9 cm) diameter shaft and a cap diameter of 1.3 inches (3.3 cm). As described in U.S. Pat. No. 3,041,266, the bolts are specified to be tightened to 120 ft-lbs (162.7 N-m) of torque, which will generate approximately 9600 lbf (42.7 kN) of compressive load from each bolt assuming a friction coefficient of 0.2. The contact area with the carbon is only the area under the bolt cap, such that the equivalent stress on the carbon is about 11,000 psi (75.8 MPa), near the breaking point for that carbon. The bolts have a yield stress of greater than 95,000 psi (655 MPa) and a tensile stress area of 0.334 square inches (2.16 $cm^2$), thus requiring 31,700 $lb_f$ (141 kN) each to reach the yield point. At that force, the pressure on the carbon would be almost 38,000 psi (262 MPa), which is well above the compressive strength of the carbon. These bolts will not plastically deform before the carbon fractures. Nickel and nickel-copper alloys such as Alloy 400 have similar strength and the results would be the same. The elastic expansion of the bolts at the fracture point of the carbon is only about 60 micrometers, while the carbon expansion is over 150 micrometers. Therefore, the carbon will fracture upon expanding.

Had the bolts been made of conventional cold-rolled copper, the bolts would have a yield stress of at least 20,000 psi (137.9 MPa). Using the same analysis as for steel, the bolts would exert about 7650 psi (52.7 MPa) of stress on the carbon before yielding. Once the anode ages and the compressive strength drops below this value, the anodes would still fracture.

Using the invention, the bolts in the example are replaced with identically sized copper bolts that have been fully heat annealed after manufacture. Fully annealed copper has a yield stress of only about 6,500 psi (44.8 MPa). It will yield more than 1% before the stress on the carbon reaches 5100 psi (35.2 MPa), thus preventing the expansion of the carbon from fracturing the carbon.

Using fully annealed copper as a bolt material is highly unusual due to the low strength of the material. This low strength prevents a bolt made from it from being tightened to high torques. In the preceding example, the annealed copper bolt can only be tightened to about 30 ft-lbs (40.7 N-m) of torque before starting to deform. Such a bolt could never be used with the original assembly specification of 120 ft-lbs (162.7 N-m) but instead would need to be tightened to a much lower value of not more than about 30 ft-lbs (40.7 N-m) of torque, or not more than 28 ft-lbs (37.96 N-m) of torque, or not more than 25 ft-lbs (33.9 N-m) of torque.

The invention can be applied to other types of connections as well. In a connection of the type proposed in JP7173664A, the portion of the threaded rod or bolt end that is inserted into the top of the carbon anode must be able to elongate vertically as the anode expands. Failure to do so will result in the conductor being pulled out of the carbon or fracture of the brittle carbon at the connecting point.

The use of a soft conductor such as fully annealed copper is again preferred in order to balance the current-carrying capacity of the rod with the need for achieving the 0.1% to 2% or more expansion needed while staying below the fracture strength of the carbon. Alternately, another deformable material including polymers, such as PTFE, combined with an alternate current-carrying pathway such as a flexible wire would achieve the same effect.

Prior art designs utilizing pressure plates to distribute the clamping force of the bolt, such as those described in KR100286717B1, do not prevent the problem of anode fracture. While such plates successfully prevent the bolts from directly exerting high pressures on the carbon, they continue to maintain high overall force across the area of the plate in contact with the carbon anode. The carbon directly underneath the plate is confined while the carbon outside the area of the plate is not and expands normally. The uneven expansion of the carbon results in very high local stresses concentrated at the lower edge of the pressure plate, where the carbon body will crack.

The present invention can be equally applied to such designs that incorporate a pressure plate. The expansion of the carbon must be accommodated without generating stress in excess of the compressive strength of the carbon, even locally at the edges of the pressure plate. To accomplish this, the structural components that carry the clamping load, which in U.S. Pat. No. 8,349,164 are described as two large bolts, must be modified. Any of the aforementioned designs would work, including the use of spring-action components such as coil springs, spring washers, or an elastic gasket between the carbon and one or more sides of the clamping surfaces in direct or indirect contact with the carbon-containing electrode, or the use of plastic deformation devices, such as low-yielding bolts or crush washers. It is however required that the thickness and deformation characteristics of the one or more deformable attachment elements are large enough to accommodate the swelling of the carbon anode.

Comparative Example 1

A set of six electrolytic cells for producing elemental fluorine by electrolysis of an HF-based molten salt utilizing an anode attachment design substantially similar to that described in U.S. Pat. No. 3,041,266A but also including a flexible member substantially similar to that described in CN204434734U by Zhu et al., was assembled but with the hanger bar and anode bolting connection area lifted up above the surface of the liquid electrolyte to reduce the rate of corrosion of the hanger bar. The cells were operated for a median lifetime of only 83 days before halting the operation due to excessively high cell voltage. Upon opening the cells, approximately half of the anodes were found to be fractured at the bolting area due to anode swelling. Prior art cells of the same design with the hanger bar submerged in the liquid electrolyte to reduce swelling last approximately 250 days, although corrosion of the hanger bar is severe.

Comparative Example 2

An electrolytic cell for producing a fluorinated gas by electrolysis of an HF-based molten salt utilizing an anode attachment design substantially similar to that described in U.S. Pat. No. 9,528,191 was constructed using 4100-series alloy steel bolts. The cell was operated for almost 6 months before failing due to multiple anode fractures near the bolting connection point.

Example 1

A set of bolts identical in size and shape to those used in Comparative Example 2 were manufactured from ASTM B-187 specification pure copper, alloy C11000. The bolts were fully heat annealed after manufacture to achieve an 060 (fully annealed) temper. The bolts were measured for plastic deformation behavior by inserting them into an electrode attachment design substantially similar to U.S. Pat. No. 9,528,191 and tightening them to progressively higher torque values. The bolts had a yield strength of about 6,500 psi (44.8 MPa) and achieved 1% plastic deformation strain when the stress on the carbon reached 3200 psi (22.1 MPa).

An electrolytic cell identical to the cell in Comparative Example 2 was constructed using the just-described fully annealed copper bolts in place of steel bolts. The initial assembly torque for the copper bolts was 20 ft-lbs (27.1 N-m). The cell was operated in parallel with the cell in Comparative Example 2, under identical conditions. The cell lasted more than 30% longer with no indications of carbon anode fracture.

Deformable attachment elements accommodate the swelling of the electrodes made of carbon-containing materials and thereby extend the lives of those electrodes. For any design that involves attachment elements including rods, screws, threaded rods, or posts partly or fully inserted into the carbon anode or compressing the carbon anode, breakage of the carbon can be delayed by using elements that deform at stresses lower than that required to fracture the carbon. In this way the operation of the assembly in an electrolytic cell will increase and reduce the number of shutdowns required for rebuilding or replacing the anode assembly.

This invention has been described by way of illustration rather than limitation and it should be apparent that this invention is applicable in fields other than those described.

The invention claimed is:

1. An electrode attachment assembly for an electrolytic cell comprising a carbon-containing electrode and one or more deformable attachment elements in direct or indirect contact with said carbon-containing electrode, wherein said one or more deformable attachment elements will deform at a stress lower than the stress that results in fracture of the carbon-containing electrode to accommodate the expansion of the carbon-containing electrode when in use, wherein the one or more deformable elements comprise fully annealed copper.

2. The electrode attachment assembly of claim 1 wherein said one or more deformable attachment elements at no time exerts more than 8,000 psi of stress on any portion of the carbon-containing electrode.

3. The electrode attachment assembly of claim 1 wherein at no time said one or more deformable attachment elements exerts more than 6,000 psi of stress on any portion of the carbon-containing electrode.

4. The electrode attachment assembly of claim 1 wherein said one or more deformable attachment elements deform at a pressure between from 4,000 to 10,000 psi of stress.

5. The electrode attachment assembly of claim 1 wherein said one or more deformable attachment elements deform at a pressure between from 4,000 to 8,000 psi of stress.

6. The electrode attachment assembly of claim 1 wherein no portion of the electrode assembly comprises a polymer.

7. The electrode attachment assembly of claim 1 wherein said fully annealed copper has mechanical properties conforming to ASTM O60 temper.

8. The electrode attachment assembly of claim 1 wherein said one or more deformable attachment elements comprises copper alloy C11000.

9. The electrode attachment assembly of claim 1 wherein said one or more deformable attachment elements have a yield strength at 0.5% extension less than 10,000 psi.

10. The electrode attachment assembly of claim 1 wherein said deformable attachment device comprises one or more selected from compression bands, straps, screws, threaded bolts, rods, threaded rods, posts, or shafts.

11. The electrode attachment assembly of claim 1 wherein said deformable attachment device comprises one or more selected from springs, coil springs, bolts, screws, bracings, crush washers, U- or C-shaped hanger bars, C-shaped clamps.

12. The electrode attachment assembly of claim 1 wherein said deformable attachment device comprises one or more selected from conical washers, spring washers, crush washers, elastomeric pads, gaskets or washers.

13. The electrode attachment assembly of claim 1 wherein said deformable attachment element comprises one or more bolts.

14. The electrode attachment assembly of claim 1 wherein said carbon-containing electrode comprises carbon selected from ungraphitized carbon, graphitized carbon, low-permeability carbon, high-permeability carbon, carbon fiber, pressed carbon powder, mesocarbon microbeads, carbon impregnated with metals, carbon coated with a thin layer of metal, carbon diamond, coal or petroleum-derived coke.

15. The electrode attachment assembly of claim 1 wherein said carbon-containing electrode is a monolithic structure, or a composite structure.

16. The electrode attachment assembly of claim 1 wherein said carbon-containing electrode is a shaped mass of compressed carbon comprising a form of coal or petroleum-derived coke and a pitch binder, baked to densify, harden, and to carbonize the pitch.

17. The electrode attachment assembly of claim 1 wherein said one or more deformable elements deforms to accommodate the expansion of the carbon-containing electrode by about 0.1% to about 1.0% without said one or more deformable elements exerting stress on the carbon-containing electrode in excess of the fracture strength of said carbon-containing electrode.

18. The electrode attachment assembly of claim 1 wherein said one or more deformable elements deforms elasticly.

19. The electrode attachment assembly of claim 1 wherein said one or more deformable elements deforms plasticly.

20. The electrode attachment assembly of claim 1 wherein said one or more deformable elements exert less than 8,000 psi of stress on the carbon-containing electrode after 0.5% expansion of the carbon-containing electrode.

21. The electrode attachment assembly of claim 1 wherein said one or more deformable elements exert less than 6,000 psi of stress on the carbon-containing electrode after 0.5% expansion of the carbon-containing electrode.

22. The electrode attachment assembly of claim 1 wherein said one or more deformable elements comprise fully annealed copper, cold-rolled copper, steel, copper-nickel alloy, lead, gold, silver, tin, zinc, aluminum, brass, bronze, and alloys thereof.

23. The electrode attachment assembly of claim 1 wherein said one or more deformable elements comprise halogenated elastomers, graphite-filled PTFE or silicone rubber.

24. The electrode attachment assembly of claim 1 wherein said one or more deformable elements comprise materials having a conductivity greater than 300 S/m.

25. The electrode attachment assembly of claim 1 wherein said one or more deformable elements are load-bearing.

26. The electrode attachment assembly of claim 1 wherein said one or more deformable elements comprises one or more bolts wherein said bolts are tightened to not more than 30 ft-lbs (40.7 N-m) of torque.

27. The electrode attachment assembly of claim 1 wherein said carbon-containing electrode is anode.

28. An electrolytic cell comprising one or more electrode attachment assemblies of claim 1, a container, an electrical distribution member, an electrolytic bath and one or more oppositely charged electrodes.

29. The electrolytic cell of claim 28 wherein said carbon-containing electrodes in said one or more electrode attachment assemblies are anodes.

30. The electrolytic cell of claim 28 wherein said electrolytic cell produces fluorine-containing materials.

31. A use of the electrolytic cell of claim 28 to manufacture fluorine-containing materials comprising the step of introducing electrical energy into said electrolytic cell to cause chemical reactions at said carbon-containing electrodes in said one or more electrode attachment assemblies and said one or more oppositely charged electrodes.

* * * * *